US006421302B1

(12) United States Patent
Wimberly

(10) Patent No.: US 6,421,302 B1
(45) Date of Patent: Jul. 16, 2002

(54) DIGITAL TIME INDICATOR

(76) Inventor: Richard C. Wimberly, 5882 Padua Dr., Huntington Beach, CA (US) 92649

( * ) Notice: Subject to any disclaimer, the term of this patent is extended or adjusted under 35 U.S.C. 154(b) by 0 days.

(21) Appl. No.: 09/613,315

(22) Filed: Jul. 11, 2000

(51) Int. Cl.[7] ..... G04B 19/00
(52) U.S. Cl. ..... 368/223; 368/228
(58) Field of Search ..... 368/223, 228, 368/232, 80, 82, 84, 239, 240, 242

(56) References Cited

U.S. PATENT DOCUMENTS

| | | | | | |
|---|---|---|---|---|---|
| 657,167 | A | * | 9/1900 | King | 368/223 |
| 3,596,462 | A | | 8/1971 | Hayes | |
| 3,852,953 | A | | 12/1974 | Mischiatti | |
| 3,968,639 | A | * | 7/1976 | Berets et al. | 368/240 |
| 3,987,617 | A | * | 10/1976 | Slob | 368/240 |
| 4,007,583 | A | * | 2/1977 | Johnson | 368/240 |
| 4,081,953 | A | * | 4/1978 | Crutcher | 368/240 |
| 4,370,068 | A | * | 1/1983 | Han | 368/240 |
| D360,594 | S | | 7/1995 | Weichhold et al. | |

FOREIGN PATENT DOCUMENTS

| | | | | |
|---|---|---|---|---|
| JP | 0284691 | * | 12/1986 | 368/242 |

* cited by examiner

*Primary Examiner*—Bernard Roskoski
(74) *Attorney, Agent, or Firm*—Stetina Brunda Garred & Brucker

(57) ABSTRACT

There is provided a digital dial face for facilitating a display of time. The dial face of the present invention comprises at least one centrally located hour indicator and a plurality of minute indicators disposed about the periphery of the hour indicator. Each of the minute indicators may be selectively operative to display a prescribed series of minutes of time. The hour indicator and the minute indicators may collectively function to facilitate the acknowledgment of time. The arrangement of the hour and minute indicators may be reversed such that a single minute indicator and a plurality of hour indicators are provided. In either case, the user may determine time by reading the alpha-numeric display of the central indicator and recognizing the position of the illuminated peripheral indicator. Information displaced on the peripheral indicator need not be read to provide an approximation of time.

15 Claims, 5 Drawing Sheets

Fig. 5
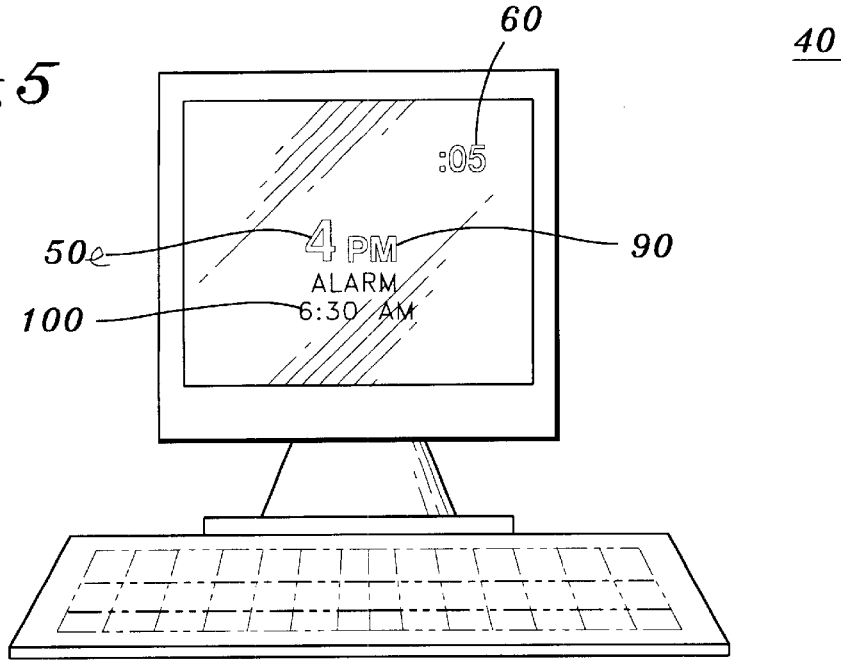
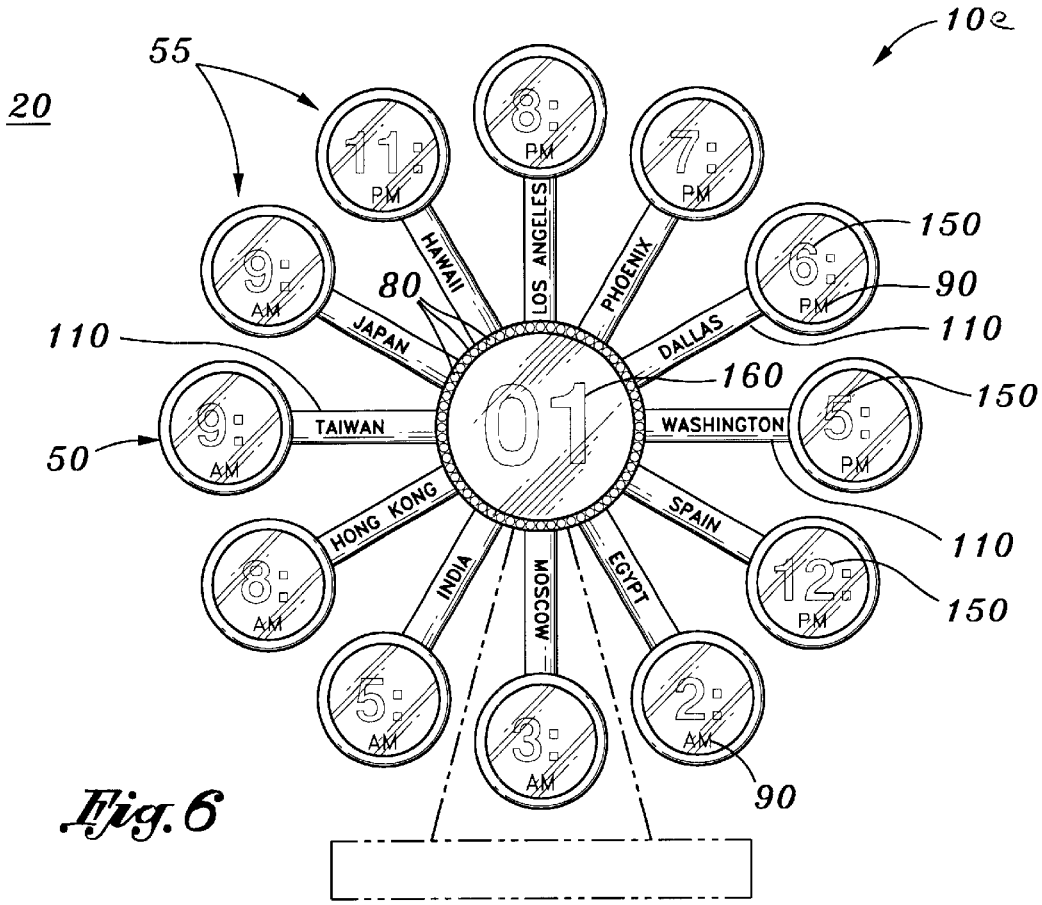
Fig. 6

DIGITAL TIME INDICATOR

CROSS-REFERENCE TO RELATED APPLICATIONS (Not Applicable)

STATEMENT RE: FEDERALLY SPONSORED RESEARCH/DEVELOPMENT (not Applicable)

BACKGROUND OF THE INVENTION

The present invention generally relates to digital timepieces, and more particularly, to timepieces combining analog and digital elements to convey time/data/information.

Various types of watches and clocks have been proposed and utilized since antiquity. Conventional timepieces utilize hands that move clockwise about a circle to define time. The locations about the circle are numbered, one through twelve, to define portions of time, as conventionally recognized. That convention is so generally understood that many timepieces don't even include numbers or other markers. The user simply recognizes from the position of the hands, what the time is by understanding information conveyed by relative locations on the dial.

Digital watches/clocks are, of course, more recent developments, through now well known and widely utilized in many forms. Digital technology provides advantages in relation to accuracy, reliability and the ability to display multiple functions such as time, date, alarm, settings, stopwatch functions, etc. Despite those significant advantages, digital watches/clocks can be difficult to read given the limited size of the display, and the amount of information that may appear within the display. Moreover, little or no information is conveyed as a result of the display arrangement. The user will typically either be able to read the display correctly, or not read it at all. The user cannot typically estimate time by glancing at the watch/clock, without being able to read the alpha/numeric information displayed thereon.

The present invention is directed to an improvement of digital displays, to take advantage of inherent recognized advantages of analog watches, in facilitate time approximation by the arrangement of digital data. This allows digital timepieces to utilize advantages of analog timepieces, while permitting the multi-function capability of digital watches. The invention may be particularly useful for individuals with poor eye sight, who might otherwise require the use of glasses to read digital displays, or individuals who otherwise draw advantage from the arrangements and functions of the invention.

BRIEF SUMMARY OF THE INVENTION

In accordance with the present invention, there is provided a digital dial face for facilitating a display of time. The dial face of the present invention comprises at least one hour indicator. The hour indicator may be operative to display a prescribed series of hours of time. The dial face further comprises a plurality of minute indicators that may be disposed about the periphery of the hour indicator, wherein each of the minute indicators may be selectively operative to display a prescribed series of minutes of time. The hour indicator and minute indicators collectively function to display time.

The hour indicator may also be displayed within a non-numerical image. The non-numerical image may further comprise an AM/PM indicator, operative to alternately display between AM and PM indicia.

In accordance with one embodiment of the present invention, the minute indicators may be spaced uniformly around the periphery of the hour indicator. Each of the minute indicators may be displayed within a respective non-numerical image.

Each of the minute indicators may be sequentially operative to display the prescribed series of minutes of time. Only one of the minute indicators may be operative when the other minute indicators are inoperative. The operative minute indicator may be configured to be inoperative after displaying the prescribed series of minutes of time, after which one of the other minute indicators is operative to display the respective prescribed series of minutes of time.

The dial face many further comprise a plurality of second indicators disposed between the hour indicator and the minute indicators, wherein each of the second indicators may be sequentially operative to display seconds of time. The dial face may also comprise an alarm indicator disposed between the at least one hour indicator and the minute indicators, wherein the alarm indicator may be operative to display a prescribed set alarm time. The hour indicator and the minute indicators of the dial face may collectively function on a clock dial, a watch dial; or a computer screen.

In another embodiment, the digital face comprises a minute indicator and a plurality of hour indicators spaced uniformly around the periphery of the minute indicator, wherein each of the hour indicators may be operative to display a respective prescribed series of hours of time. The minute indicator and the hour indicators may collectively function to facilitate a display of time.

The dial face may include a plurality of second indicators disposed between the minute indicator and the hour indicators, wherein each of the second indicators may be sequentially operative to display seconds of time. A plurality of elongated arms may be provided into connecting the periphery of the minute indicator with each of the hour indicators, wherein each of the elongated arms may display various locations temporally corresponding to the interconnected minute indicator and hour indicators.

Furthermore, the hour indicators may be displayed within a respective non-numerical image, wherein the non-numerical image each has an AM/PM indicator operative to alternatively display between AM and PM indicia. The minute indicator and the hour indicators may collectively function on a clock dial.

A variety of alternate embodiments of the invention are illustrated and described herein. As such, the invention is not intended to be limited to a specific embodiment, but rather more broadly directed to the merger of a digital display and positional information recognizable as representative of time related information. As such the invention provides an easy-to-read timepiece which conveys significant quantities of time information and formed that minimizes alphanumeric content and takes advantage of cognitive understanding of positional and other graphic displays.

BRIEF DESCRIPTION OF THE SEVERAL VIEWS OF THE DRAWING

These are well as other features of the present invention, will become more apparent upon reference to the drawings wherein:

FIG. 5 is an elevational view of a dial face as implemented on a computer screen;

FIG. 6 is an elevational view of a digital dial face defining a minute indicator with a plurality of hour indicators there around;

DETAILED DESCRIPTION OF THE INVENTION

Figure 1:
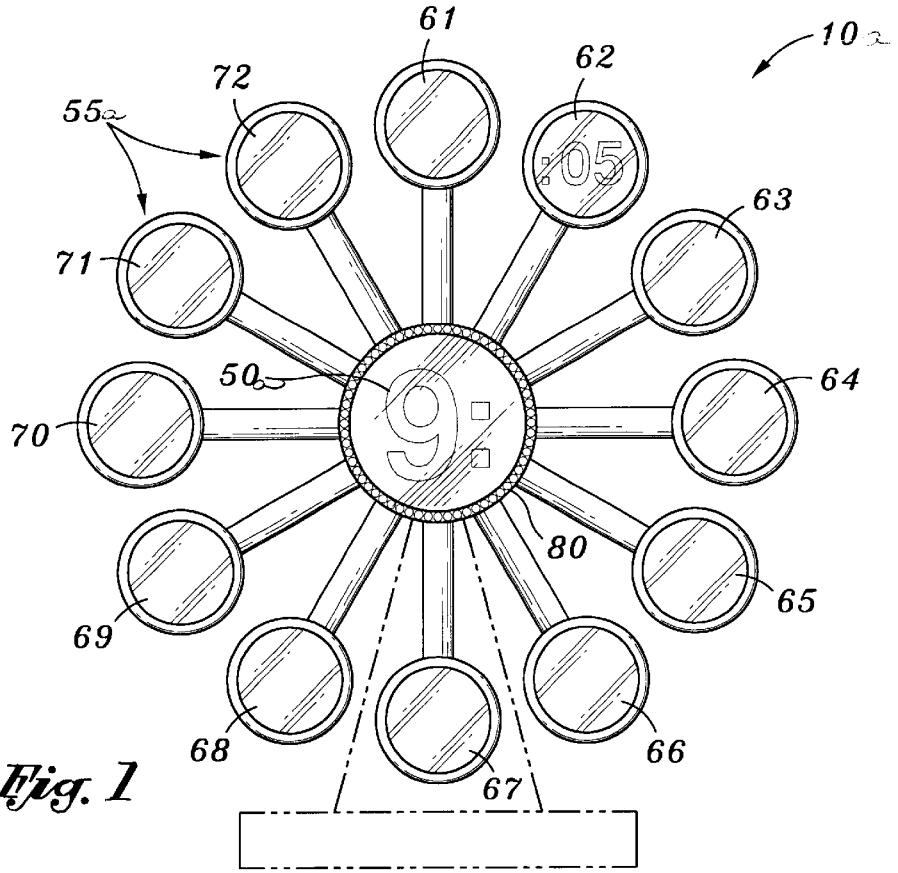
FIG. 1 is an elevational view of a digital dial face for a clock constructed in accordance with a preferred embodiment of the present invention and defining an hour indicator with a plurality of minute indicators there around.

Referring now to the drawings wherein the showings are for purposes of illustrating preferred embodiments of the present invention only, and not for purposes of limiting the same, FIG. 1 illustrates an elevational view of a digital dial face 10 for a clock 20 constructed in accordance with a preferred embodiment of the present invention. In this regard, the dial face 10 may be comprised of any of a variety of materials and shapes, such as round, square, rectangle, diamond, oval, etc. The configuration of the dial face 10 in FIG. 1 is only a symbolic representation thereof, and the shape of the dial face 10 should not solely be limited thereto.

Similarly, the dial face 10 may also have a variety of dimensions. For instance, it will be contemplated by those of ordinary skill in the art that the dial face 10 may be formed with different heights, lengths, width, depth, and circumference (if circular). Simply put, there should not be any limitations to the dimensions of the dial face 10 of the present invention.

Figure 2:
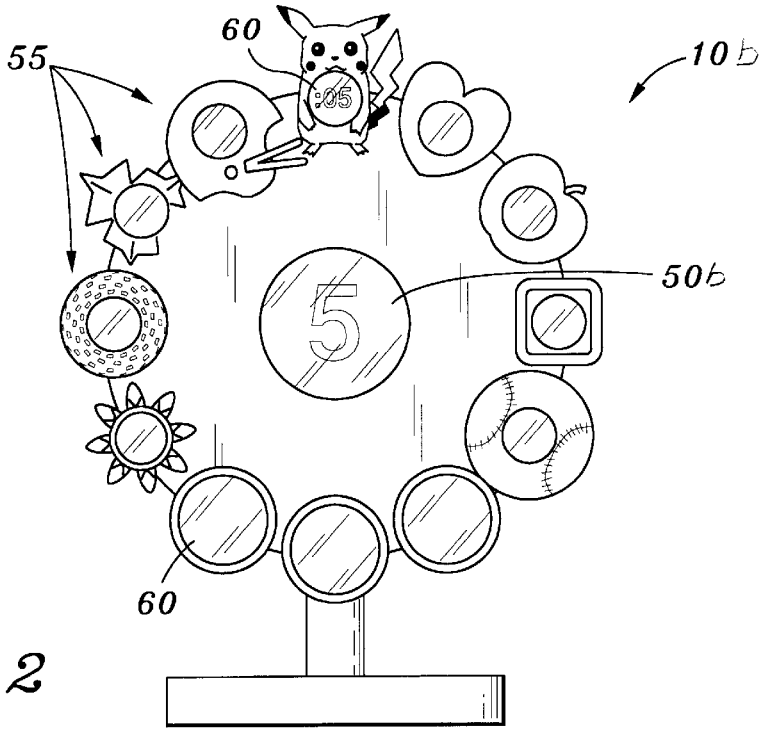
FIG. 2 is an elevational view of an alternate dial face depicting various types of non-numerical images that may surround the minute indicators.

Referring now in FIGS. 1 and 2, the dial face 10*a, b* may be configured to be utilized in a clock 20. However, as will be discussed more fully below, such utilization of the dial face constitutes only one possible application of the present invention, and may be used in other applicable settings as well, such as with a watch or a computer screen.

As will be apparent to those of ordinary skill in the art, the dial face 10*a* of the clock 20, may be battery operated, using a vibrating quartz crystal as the time base for a microprocessor circuit.

Referring again to FIG. 1, the dial face 10*a* comprises an hour indicator 50*a* disposed central to the dial face, and a plurality of minute indicators 61–72 arrayed concentrically about the hour indicator. The hour indicator 50 and the minute indicators 61–72 may be comprised of any variety of shapes or configurations, and the round configuration of the hour indicator 50*a* and the minute indicators in FIGS. 1 and 2 is only one symbolic representation from many possibilities. Moreover, as shown at FIG. 2, the hour indicator 50*b* and each of the minute indicators 55 may be circumscribed by a ring of sequentially operative indicator lights which may step through sixty (60), one second increments. The non-numerical images 55 may be any types of images, such as a heart, a flower, a turtle, a star, a golf ball, a baseball, a leaf, a football helmet, an apple, or simply any fashionable or trendy design. Simply put, utilizing the images 55 mentioned, the manufacturer may aesthetically enhance the appearance of the dial face 10 at his or her choosing.

The hour indicators 50*a, b* may be generally positioned in the center of the dial face 10. Furthermore, the hour indicator typically functions to display a prescribed series of hours of time (e.g., 12 or 24 hours). However, in another embodiment, the central indicator may display the minutes, and the peripheral indicators may sequentially display hours. In either case, the central indicator will display one time function, and the peripheral indicators will sequentially illuminate to display another time function.

In the embodiments shown at FIGS. 1–5, 7 and 8*a,* the minute indicators are disposed about a periphery of a central hour indicator. In the embodiments shown at FIGS. 6 and 8*b,* the hour indicators are disposed about the periphery of a central minute indicator. Both the hour and minute indicators may be implemented as conventional LDC or LED displays. Each of the minute indicators may be selectively operated to display a respective prescribed series of minutes of time, e.g., 1–5, 6–10, etc. Where the peripheral indicators function as hour indicators, each such indicator will typically display a single number, e.g., 1, 2, 3, etc.

Where the peripheral indicators function as minute indicators, each of the 12 minute indicators would typically be capable of displaying five numbers only. A topmost minute indicator may incrementally sequence and display the numbers 56 through 00, wherein such number increments every 60 seconds, beginning with the number 56 and ending with the number 00. Sixty seconds after the number 00 has been displayed, the topmost minute indicator 61 would be deactivated (blanked out). Thereafter, a first minute indicator 62 to the immediate right may be activated (light up) to display the numbers 01 through 05, incrementing every 60 seconds and representative of one minute past the hour through five minutes past the hour. Sixty seconds after the number 05 is displayed, the first minute indicator 62 may be blanked out and a second minute indicative 63 may display the numbers 06 through 10, incrementing every sixty seconds. This sequence would continue with successive minute indicators being activated and deactivated for five minutes, every hour until the time progression is completed and repeated thereafter.

Figure 3:
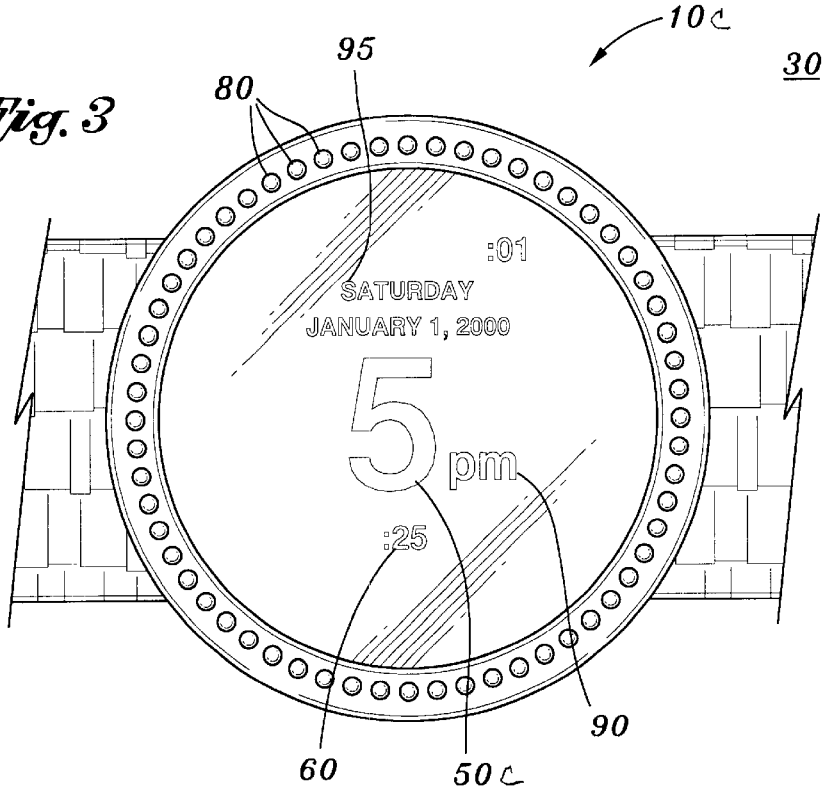
FIG. 3 is an elevational view of another dial face.

As shown in FIGS. 1 and 3, the dial face 10 further comprises a plurality of second indicators 80. More specifically, the second indicators 80 may be disposed about the periphery of hour indicator 50*a,* 50*c*.

The second indicators 80 are typically operative to display seconds of time. More specifically, the second indicators 80 (FIGS. 3, 4), may be arrayed and sequential about the clock face periphery in a clockwise direction to display the seconds of time, on in the alternative, placed adjacent to each of the minute indicators 60 (FIGS. 2, 7), to display the seconds digitally. One of the second indicators 80 are preferably activated to display a specified second of time, and deactivated thereafter. Then, one of the other second indicator 80 that is immediately right thereto may be activated to indicate the next second of time, and subsequently deactivated. This pattern may continue until all of the second indicators has been activated, which equals to 60 seconds, or 1 minute. Such pattern will continue to display the next set of 60 seconds.

Furthermore, the dial face 10 may have an AM/PM indicator 90 FIGS. 3, 5, 7, 8*a, 8b*). The AM/PM indicator 90 maybe comprised of an AM indicia and a PM indicia. The AM/PM indicator 90 may be operative to alternately display between the AM and PM indicia, depending on the time. If it is AM part of the day, then the AM indicia would be activated (lit up) while the PM indicia remains deactivated (blanked out). If it is PM part of the day, then the PM indicia would be activated while the AM indicia remains deactivated. Moreover, although the AM/PM indicator 90 may be placed anywhere on the dial face 10, it may be preferable to be immediately disposed adjacent to the hour indicator 50.

In addition, the dial face 10 may further comprise a date indicator 95 (FIGS. 3, 5, 7, 8*a*, 8*b*). The date indicator 95 may be positioned anywhere on the dial face 10. The date indicator 95 maybe operative to display the date by activating indicia that are expressive thereof. Such data may include the month, the day, the year, and/or the day of the week. The date indicator 95 may progressively operate to conform to the current date.

Figure 4:
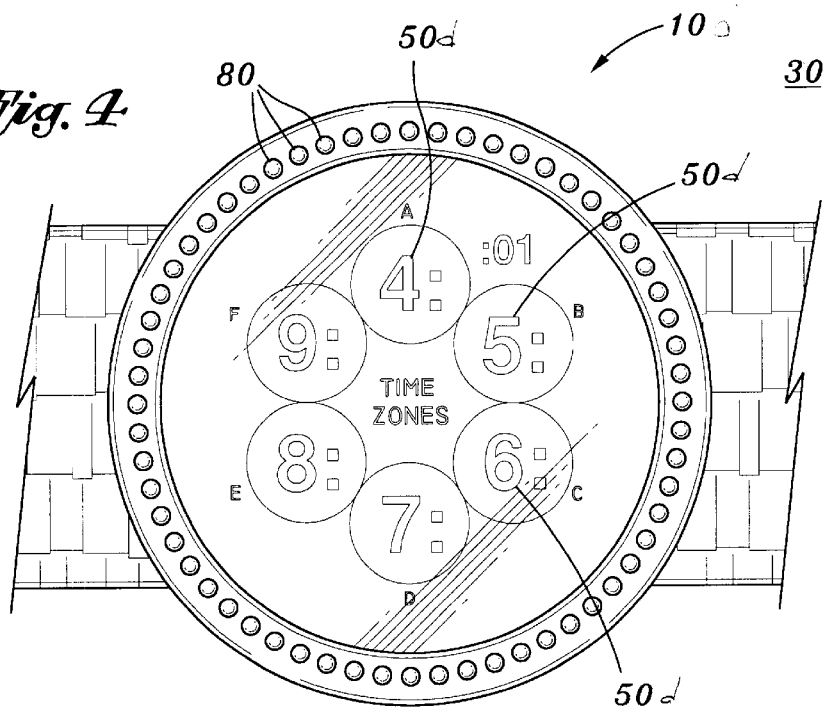
FIG. 4 is an elevational view of another dial face with a plurality of hour indicators.

FIG. 4 illustrates an embodiment having more than one hour indicator 50*d*. Each hour indicator 50*d* may simultaneously display different hours of the time corresponding to different time zones.

As shown at FIG. 5, the dial face 10 may further comprise an alarm indicator 100. The alarm indicator 100 is operative to display a prescribed set alarm time that indicates when the alarm will be triggered. For instance, if the alarm indicator 100 displays 6:30 AM, then the alarm will sound at that time. It will be contemplated by those of ordinary skill in the art that a conventional alarm may be installed within the clock 20, watch 30, or any variety of other timepieces.

As shown in FIG. 5, the dial face 10 of the present invention may be utilized with the computer screen 40. In other words, the dial face 10, as described above, may be implemented in computer software and displayed on the computer screen 40 to be used therewith. The dial face 10 functioning on the computer screen 40 may be used as a computer clock. Moreover, the dial face 10 may further be used as a screen saver to move around the computer screen 40.

As will be recognized by those of ordinary skill in the art, the dial face 10 of the present invention may be applicable with many aspects of the field. For instance, the time on the dial face 10 may be set by utilizing the Global Position Satellites. In addition, setting time on the dial face 10 may be facilitated by coupling the use of a remote control therewith. Furthermore, the dial face 10 may also be installed with standard voice boxes to audibly output the time.

Referring now to FIG. 6, the dial face 10 may be rearranged to provide another embodiment of the present invention. In that embodiment, the dial face 10 may have a minute indicator 160 generally placed in the center area thereof. The minute indicator 160 may display a two digit number, wherein the two digit number may simply be activated in an arranged fashion to indicate the desired minutes of time. The two digit number may progressively increase from 1 to 60 minutes, wherein the cycle is continuously repeated.

In such an embodiment, the dial face 10 may further have a plurality of hour indicators 150 spaced uniformly around a periphery of the minute indicator 160. Each of the hour indicators 150 may be simultaneously operative to display a respective prescribed series of hours of time. For instance, if the manufacturer chooses to have 12 hour indicators 150 on the dial face, then each of the 12 hour indicators 150 may display the correct hour corresponding to an associated time zone.

In addition, the dial face 10 may have a plurality of elongated arms 110 interconnecting the periphery of the minute indicator 160 and each of the hour indicators 150. The elongated arms 110 may be present on the dial face 10 for cosmetic purposes. In the alternative, the plurality of interconnecting elongated arms 110 may be labeled to display various locations temporally corresponding to the associated hour indicator.

Figure 7:
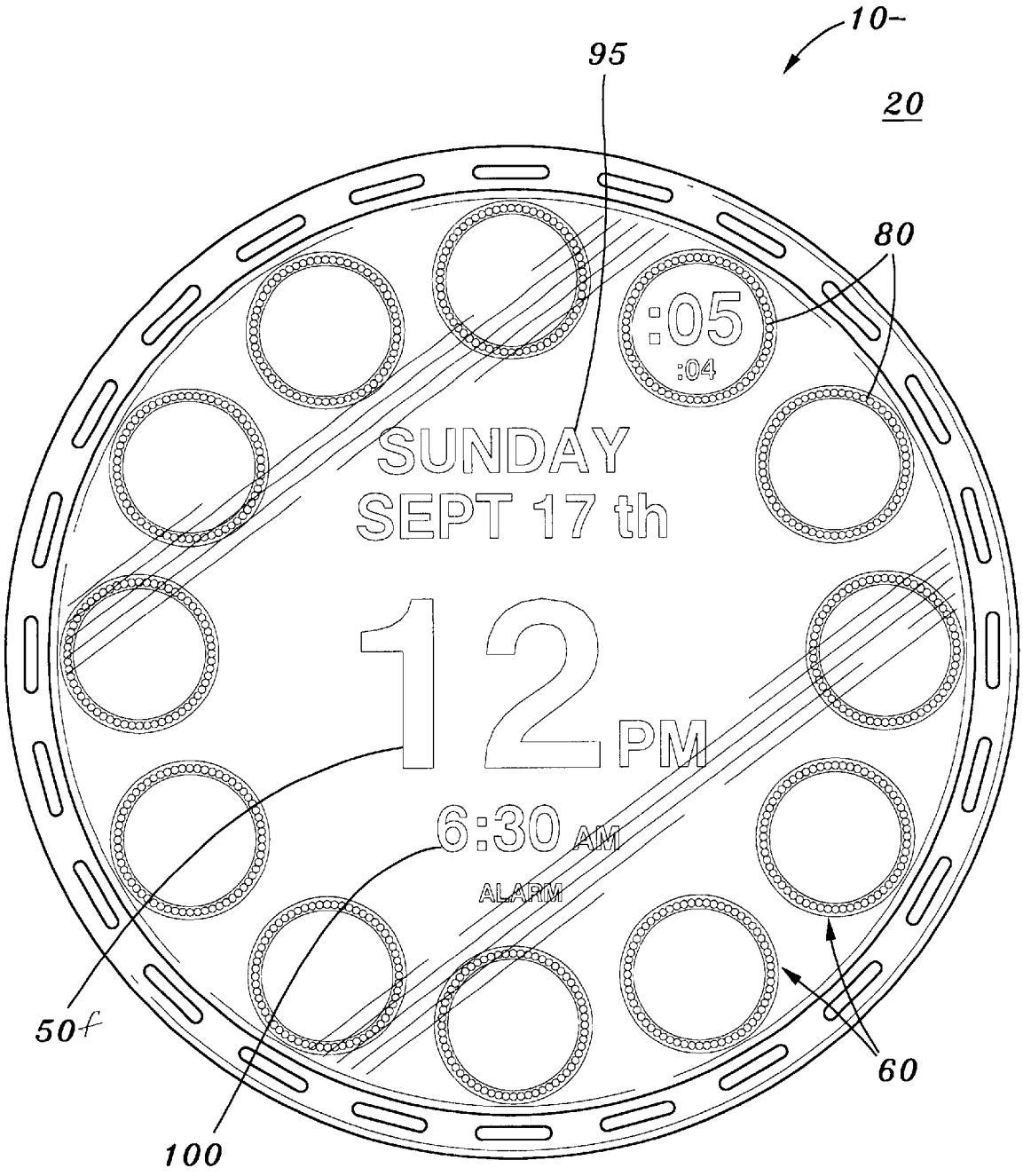
FIG. 7 is an elevational view of a digital dial face wherein the second display to disposed about the minute display.

FIG. 7 illustrates an embodiment comprising a centrally disposed hour indicator 50*f* and a series of peripherally disposed minute indicators 60. As described above, the minute indicators sequentially illuminate, to sequence through a series of assigned numbers for the particular minute indicator. A second display may be incorporated into the minute indicator and/or illustrated by virtue of a ring of second indicators 80 disposed about the minute indicator.

Figure 8A:
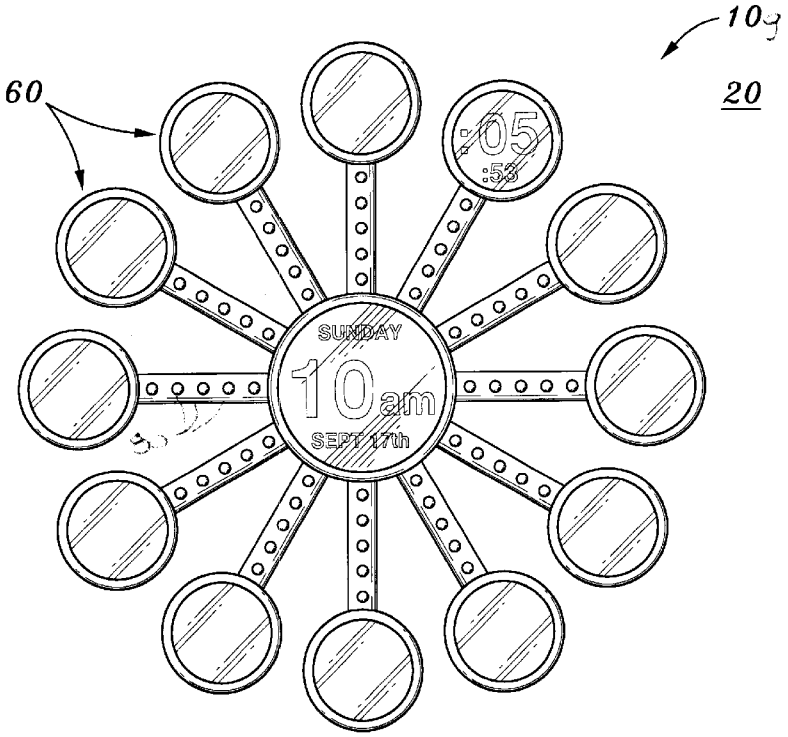
FIG. 8*a* is an elevational view of a digital dial face wherein the second display extends radially from the hour display to the minute display.
Figure 8B:
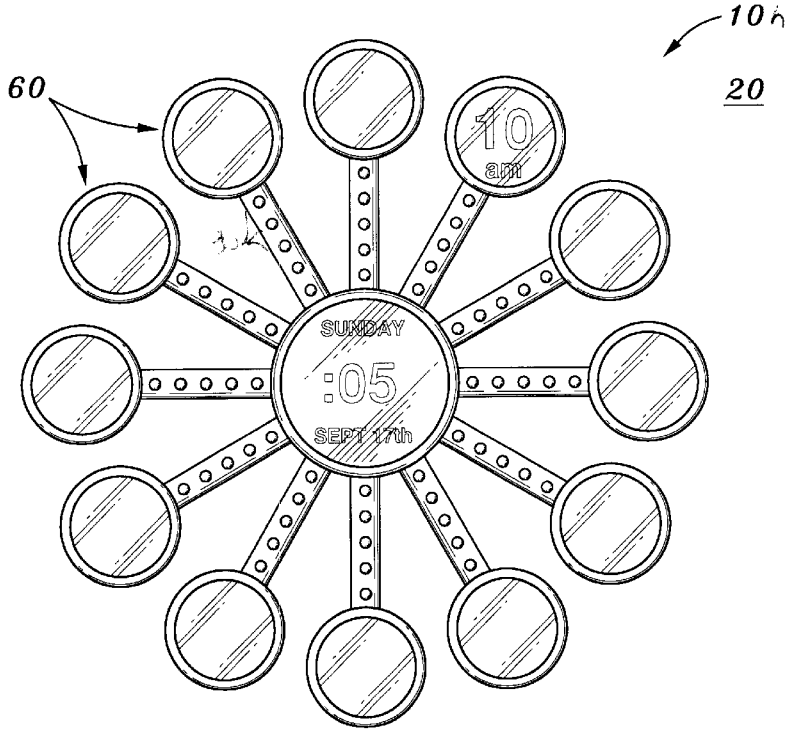
FIG. 8*b* is a modification of FIG. 8*a,* with the hour and minute indicators reversed.

FIG. 8*a*, 8*b* illustrate two generally similar embodiments, with a different arrangement of hour and minute indicators. As illustrated in FIG. 8*a*, 8*b*, the second indicators 80 may be implemented as a series of spokes extending radially from the central indicator to the peripheral indicators. In such embodiment, it is anticipated that the radially extending indicators would progress through a multiple number of sequential illuminating cycles during the course of each minute. In another embodiment, the radially extending indicators would operate as minute indicators, such that each indicator as illuminated only once in each minute.

The various embodiments described above provide both format information, based on an analog to a conventional analog timepiece, as well as alpha-numeric information, derived from the content of the digital display. The present invention therefore takes advantage of both the associative qualities of a conventional analog timepiece, and the varied informational capacity of digital displays.

Thus, in practice, a user may simply glance of the timepiece and obtain a general sense of hours or minutes by noting which of the peripheral indicators is illuminated. The centrally located indicator is preferably implemented in a larger size display, such that the information disposed in the central indicator, e.g., hours or minutes, can be easily read at a glance. As such, a user may typically known the hour and approximate minute without the need to look more closely at the smaller minute displays disposed about the periphery of the timepiece. Where the minute display comprises a central display, the user will typically be able to easily read the minutes, and know the hours by simply recognizing which of the peripheral displays is illuminated. The second information may also be visually conveyed by virtue of the circular progression of second indicators. As such second information may be visually conveyed without the need to read the smaller, multi-function alpha-numeric indicators.

Accordingly, the present invention utilizes a fusion of cognitively conveyed information, in combination with digital displays. By such advantageous fusion, the present invention allows for both ease of time approximation, without the need for back illumination of dials, or other reading adjustments. The more detailed time/dates/time zone information is also available to provide further details, as may be of interest to a particular user.

The foregoing description sets forth implementations for the present invention, as currently anticipated. However, it is to be understood that various other broader aspects of the invention may be derived without departing from the broader spirit and scope of the invention, as set forth herein. Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A digital timepiece dial face comprising:

a) a timepiece display having a center region and a periphery region;

b) at least one hour indicator disposed in the center region, the hour indicator being operative to display a prescribed series of hours of time; and c) a plurality of minute indicators disposed about the periphery, each of the minute indicators being disposed at a dedicated location selected to communicate an approximate time, each of the minute indicators further having a numerical display disposed thereon for representing a precise time over a set interval such that the approximate time is communicated when the face is briefly viewed and the precise time is communicated when the face is closely viewed;

d) wherein the hour indicator and the minute indicators collectively function to display time numerically and positionally.

2. The timepiece as set forth in claim 1 wherein the prescribed series of hours of time is numerically sequenced.

3. The timepiece as set forth in claim 1 further comprising a series of sequentially illuminated seconds indicators disposed about the hour indicator.

4. The timepiece as set forth in claim 1 wherein the minute indicators are spaced uniformly around the periphery of the hour indicator.

5. The timepiece as set forth in claim 4 wherein only one of the minute indicators is illuminated at a time.

6. The timepiece as set forth in claim 1 wherein the hour indicator and one of the minute indicators collectively function to display the hour and minute of time.

7. The time piece as set forth in claim 1 wherein the minute indicators comprise twelve minute indicators, each operative to sequence through five (5) uniquely assigned numbers.

8. A timepiece comprising:

a) a first time indicator substantially centered upon a clock face and operative to display a first time function;

b) a plurality of second time indicators, arrayed concentrically about the first time indicator, at a first distance therefrom, operative to display a second time function, each of the second time indicators being disposed at a dedicated location selected to communicate an approximate time and having a numerical display thereon for representing the precise time ever a set interval, such that the approximate time is communicated when the second time indicator is briefly viewed and the precise time is communicated when the second time indicator is closely viewed; and c) a plurality of third time indicators, arrayed concentrically about the first time indicator, at a first distance therefrom, operative to display a third time function.

9. The timepiece as recited in claim 8, wherein the first distance is greater than the second radius.

10. The timepiece as recited in claim 8, wherein the first time function is an hour display function.

11. The timepiece as recited in claim 8, wherein the second time function is a minute display function.

12. The timepiece as recited in claim 8, wherein the third time function is a second display function.

13. The timepiece as recited in claim 8, wherein the first and second time indicators are each an individual LCD display.

14. The timepiece as recited in claim 1, wherein the first, second and third time indicators are each an individual LCD display.

15. The digital timepiece as recited in claim 8, wherein the second time indicators comprise a plurality of sequentially operative minute indicators, each minute indicator being operative to display a series of numbers uniquely assianged thereto.

* * * * *